US011527377B2

(12) United States Patent
Einschenk et al.

(10) Patent No.: US 11,527,377 B2
(45) Date of Patent: Dec. 13, 2022

(54) QUICK-RELEASE LATCH, RELEASE MECHANISM AND HIGH-SPEED GROUNDING SWITCH, HIGH-SPEED SWITCH OR SHORT-CIRCUITER

(71) Applicant: SIEMENS AKTIENGESELLSCHAFT, Munich (DE)

(72) Inventors: Juergen Einschenk, Panketal (DE); Peter Stracke, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 17/279,190

(22) PCT Filed: Sep. 3, 2019

(86) PCT No.: PCT/EP2019/073387

§ 371 (c)(1),
(2) Date: Mar. 24, 2021

(87) PCT Pub. No.: WO2020/064273

PCT Pub. Date: Apr. 2, 2020

(65) Prior Publication Data

US 2022/0005660 A1 Jan. 6, 2022

(30) Foreign Application Priority Data

Sep. 24, 2018 (DE) ..... 102018216210.7

(51) Int. Cl.
*H01H 71/50* (2006.01)
*H01H 3/46* (2006.01)
*H01H 71/24* (2006.01)
*H01H 71/52* (2006.01)

(52) U.S. Cl.
CPC ..... *H01H 71/505* (2013.01); *H01H 3/46* (2013.01); *H01H 71/2463* (2013.01); *H01H 71/52* (2013.01)

(58) Field of Classification Search
CPC ..... H01H 71/505; H01H 3/46
See application file for complete search history.

(56) References Cited

U.S. PATENT DOCUMENTS 1,240,314 A * 9/1917 Cheney ..... H01H 3/46 218/7
1,522,187 A * 1/1925 Herman ..... H01H 3/46 335/25
1,807,041 A * 5/1931 Lingal ..... H01H 71/505 74/2
2,601,422 A 6/1952 Thumim
3,728,508 A * 4/1973 Netzel ..... H01H 3/46 218/7

(Continued)

FOREIGN PATENT DOCUMENTS

DE 2557276 A1 11/1976
DE 102012111391 A1 5/2014

(Continued)

*Primary Examiner* — Alexander Talpalatski
(74) *Attorney, Agent, or Firm* — Laurence A. Greenberg; Werner H. Stemer; Ralph E. Locher

(57) ABSTRACT

A particularly reliable quick release latch and a release mechanism, as well as a quick grounding device or short circuiter, is particularly suited for low, medium, and/or high-voltage applications.

15 Claims, 5 Drawing Sheets

(56) References Cited

U.S. PATENT DOCUMENTS

| | | | | |
|---|---|---|---|---|
| 3,964,338 | A * | 6/1976 | Benson | G05G 1/04 218/92 |
| 4,935,712 | A | 6/1990 | Oyama et al. | |
| 5,777,536 | A * | 7/1998 | Lee | H01H 36/0073 335/190 |
| 6,222,433 | B1 * | 4/2001 | Ramakrishnan | H01H 71/505 335/35 |
| 6,225,881 | B1 * | 5/2001 | Felden | H01H 71/04 335/172 |
| 2013/0284703 | A1 * | 10/2013 | Yoshitomo | H01H 33/98 218/84 |

FOREIGN PATENT DOCUMENTS

| | | | |
|---|---|---|---|
| EP | 0197739 | A2 | 10/1986 |
| EP | 1014415 | A1 | 6/2000 |
| EP | 2624272 | A1 | 8/2013 |

* cited by examiner

QUICK-RELEASE LATCH, RELEASE MECHANISM AND HIGH-SPEED GROUNDING SWITCH, HIGH-SPEED SWITCH OR SHORT-CIRCUITER

BACKGROUND OF THE INVENTION

Field of the Invention

The invention relates to a quick-release and particularly reliable latch and to a release mechanism and a high-speed grounding switch or a high-speed switch, in particular an on/off switch and circuit breaker, or short-circuiter, in particular for low-voltage, medium-voltage and/or high-voltage applications.

The switching times, that is to say the speed required by a switch, in particular a high-speed grounding switch or short-circuiter, to perform a switching operation following a switching signal, are also closely linked to the release mechanism. The prior art discloses high-speed release mechanisms which are based, like EP 2624272 A1, on chemical propellant charges. These have the disadvantage that a high level of outlay is required if the switch is to be reused. Latches provided by means of ball locks, half-shafts and cages are also known, but these are disadvantageous, in particular, in respect of reliability.

SUMMARY OF THE INVENTION

It is the object of the invention, then, to provide a latch, release mechanism and high-speed grounding switch or short-circuiter which releases reliably, at high speed, and can be enhanced by straightforward means so that, once switching operation has already taken place, it can be moved into standby again for renewed switching operation.

The object is achieved by the independent claim(s) and the claims which are dependent thereon.

One exemplary embodiment relates to a latch for low-voltage applications, medium-voltage applications and/or high-voltage applications, having at least the following constituent parts:

- a drive rod for driving a movement,
- a connecting element, wherein the connecting element is designed in the form of a separate component or for integration in the drive rod,
- a lever-arm pair,
- a transmission-element pair,
- a locking element and
- a locking-element counterpart, wherein the latch is constructed such that a relatively pronounced first force, which acts on the drive rod, is reduced by the connecting element, the lever-arm pair, and the transmission-element pair such that a smaller, second force is sufficient to deflect the locking element such that a movement of the drive rod relative to the rest of the constituent parts is no longer prevented by the locking element or by the locking element and the locking-element counterpart.

The locking element thus prevents a movement of the drive rod in a first end position of the latch. If the locking element is moved out of its locking position by means of a second force, for example by a magnetic actuator, then the locking action of the locking element is thus eliminated and the drive rod, driven by the first force, can move in a predetermined direction.

The first force is generated preferably by a spring or a spring assembly, in particular by cup springs or a cup-spring assembly.

It is preferred if the latch is movable between a first end position and a second end position, and

- the drive rod is connected to the connecting element,
- the connecting element has a first rotary pin and a second rotary pin, and wherein a first lever arm is fastened in a rotatably mounted manner on the first rotary pin and a second lever arm is fastened in a rotatably mounted manner on the second rotary pin,
- the first lever arm has a first lever-arm pin and the second lever arm has a second lever-arm pin,
- the first transmission element is connected in a movable manner to the first lever arm via the first lever-arm pin and the second transmission element is connected in a movable manner to the second lever arm via the second lever-arm pin,
- the first transmission element can be mounted, or is mounted, in a rotatable manner on a first housing part via a first fastening pin and the second transmission element can be mounted, or is mounted, in a rotatable manner on a second housing part via a second fastening pin,
- the first transmission element or second transmission element is connected to a rotatably mounted locking element via a locking-element pin, wherein the locking element can be mounted on a locking-element counterpart or is connected to the locking-element counterpart, wherein the locking-element counterpart is connected in a fixed or rotatable manner to the second transmission element or the first transmission element,
- during transfer from the first end position into the second end position, the drive rod moves away from the first fastening pin on the first transmission element, and from the second fastening pin on the second transmission element, and the locking-element pin and the locking-element counterpart move toward one another, and,
- during transfer from the second end position into the first end position, the drive rod moves toward the first fastening pin on the first transmission element, and toward the second fastening pin on the second transmission element, and the locking-element pin and the locking-element counterpart move away from one another,
- in the first end position, the locking element is arranged between the first transmission element and the second transmission element such that a movement of the transmission-element pair is inhibited. It is possible here for the drive rod to be connected in a detachable or undetachable manner to the connecting element.

It is also preferred if one or more of the following components:

- a connecting element, wherein the connecting element is designed in the form of a separate component or for integration in the drive rod,
- a lever-arm pair,
- a transmission-element pair, are duplicated, that is to say there are two connecting elements arranged parallel to one another and/or two lever-arm pairs arranged parallel to one another and/or two transmission-element pairs arranged parallel to one another. This duplication results in further-improved stability of the construction of the latch and therefore also in increased reliability.

In particular, it is preferred if the duplicated components are arranged symmetrically around one end of the drive rod. This gives rise to additional stabilization of the latch.

It is also preferred if the locking element and the locking-element counterpart are connected to one another in a movable, in particular rotatable, manner at a connecting location, wherein the locking-element counterpart is connected in a rotatable manner to the second transmission element or the first transmission element, and therefore, in the first end position, the locking element and the locking-element counterpart are located in a straightened-out state, in which the latch is prevented from moving into the second end position, and therefore, in the second end position, the locking element and the locking-element counterpart are located in an inflected state, so that, in comparison with the first end position, the connecting location has moved in the direction of the drive rod.

The second force is particularly preferably applied at the connecting location at which the locking element and the locking-element counterpart are connected to one another in a movable manner.

It is also preferred if the locking element and the locking-element counterpart are connected in a movable manner by a rotary pin at the connecting location, the locking-element counterpart is connected in a rotatable manner to the second transmission element or the first transmission element by a pin or a bearing, wherein the connecting location is arranged approximately centrally between the bearing and the locking-element pin.

The second force is also particularly preferably applied at the connecting location at which the locking element and the locking-element counterpart are connected to one another in a movable manner.

It is also preferred if, in the first end position, the locking element is mounted on the locking-element counterpart such that the locking element prevents the latch from moving out of the first end position. Mounted should be understood to mean here, in particular, that the reduced first force pushes the locking element against the locking-element counterpart, that is to say the locking element is supported against the locking-element counterpart, and a movement of the drive rod is thus prevented.

It is particularly preferred if the locking-element counterpart is designed in the form of a roller. This gives rise to the locking element, on the one hand, being supported in a stable manner on the locking-element counterpart but, on the other hand, rolling with low losses over the locking-element counterpart.

In particular, it is preferred if an end of the locking element which is to be supported on the locking-element counterpart has a planar, that is to say rectilinear, or round shape with a first radius and the locking element is supported in a stable manner, in particular in a more stable manner, on the locking-element counterpart in that, in the case of the round shape, the center point of the first radius does not pass through the center point of the rotary pin of the locking element, that is to say the center point of the first radius is not located on a straight line which passes through the center point of the rotary pin of the locking element and the center point of the bearing of the locking-element counterpart; rather, in the first end position, it is offset in relation to said straight line toward the side which is directed away from the drive rod, that is to say there is an offset present, in particular an offset by 0.3 to 1.2 mm or 0.4 to 1.0 mm. The first radius here is preferably greater than a second radius of the locking-element counterpart, in particular with the locking-element counterpart being in the form of a roller.

It is also particularly preferred if the bearing is a needle bearing. Such a needle bearing has a particularly low rolling resistance and nevertheless exhibits preferred long-term stability.

It is also preferred if a locking-element-return device is provided on the locking element such that, when the latch is being transferred from the second end position into the first end position, the locking-element-return device causes the locking element to be returned to its position between the first transmission element and the second transmission element, and therefore a movement of the transmission-element pair is inhibited and the locking element butts against the locking-element counterpart.

It is also preferred if, in a region on the side which, in the first end position, is directed away from the drive rod, the locking element has an indent, which corresponds to part of the outer contour of the locking-element counterpart, or replicates the same.

It is also preferred if the first transmission element and the second transmission element are arranged in a movably mounted manner on the same side, or on opposite sides, of the connecting element, or the connecting element is formed from two connecting-element parts, and the first transmission element and the second transmission element are arranged in a movably mounted manner between the two connecting-element parts.

A further exemplary embodiment relates to a release mechanism for a high-speed switch, having a latch according to one or more of the refinements above, wherein a magnetic plunger of a magnetic drive or some other release unit can move the locking element out of the first end position, in which the movement of the transmission-element pair is inhibited.

It is also preferred if, in the first end position, the locking element butts on or against a locking-element stop. The locking-element stop is arranged, in particular, such that it inhibits a movement of the locking element in the direction of the magnetic plunger or of the other release unit beyond the first end position, in which the movement of the transmission-element pair is inhibited, and it thus forms a defined starting position of the locking element in the first end position, in which the movement of the transmission-element pair is inhibited.

It is particularly preferred if the locking-element stop is arranged on the magnetic drive or on one or more housing parts. It is particularly advantageous for the locking-element stop to be arranged on one or more housing parts since this creates a better, defined state for the latch in the first end position, which also makes it easier to fit the latch to form a release mechanism.

It is also preferred if the first transmission element can be mounted, or is mounted, in a rotatable manner on a first housing part via a first fastening pin and the second transmission element can be mounted, or is mounted, in a rotatable manner on a second housing part via a second fastening pin, and the first housing part and the second housing part are fastened in an immovable manner in a housing of the release mechanism or form the housing.

It is also preferred for the housing to be formed in one or more parts.

A further exemplary embodiment relates to a high-speed grounding switch or short-circuiter having a release mechanism according to one or more of the refinements above, wherein the release mechanism is arranged, together with the switch, in a housing and, following switching from the first end position into the second end position, the release mechanism can be restored in a reversible manner into the first end position. Such a high-speed grounding switch or such a short-circuiter has the advantage that they are particularly reliable, long-lasting and have high-speed switching capability.

BRIEF DESCRIPTION OF THE SEVERAL VIEWS OF THE DRAWING

The invention will be explained in more detail hereinbelow with reference to figures, in which.

DETAILED DESCRIPTION OF THE INVENTION

Figure 1:
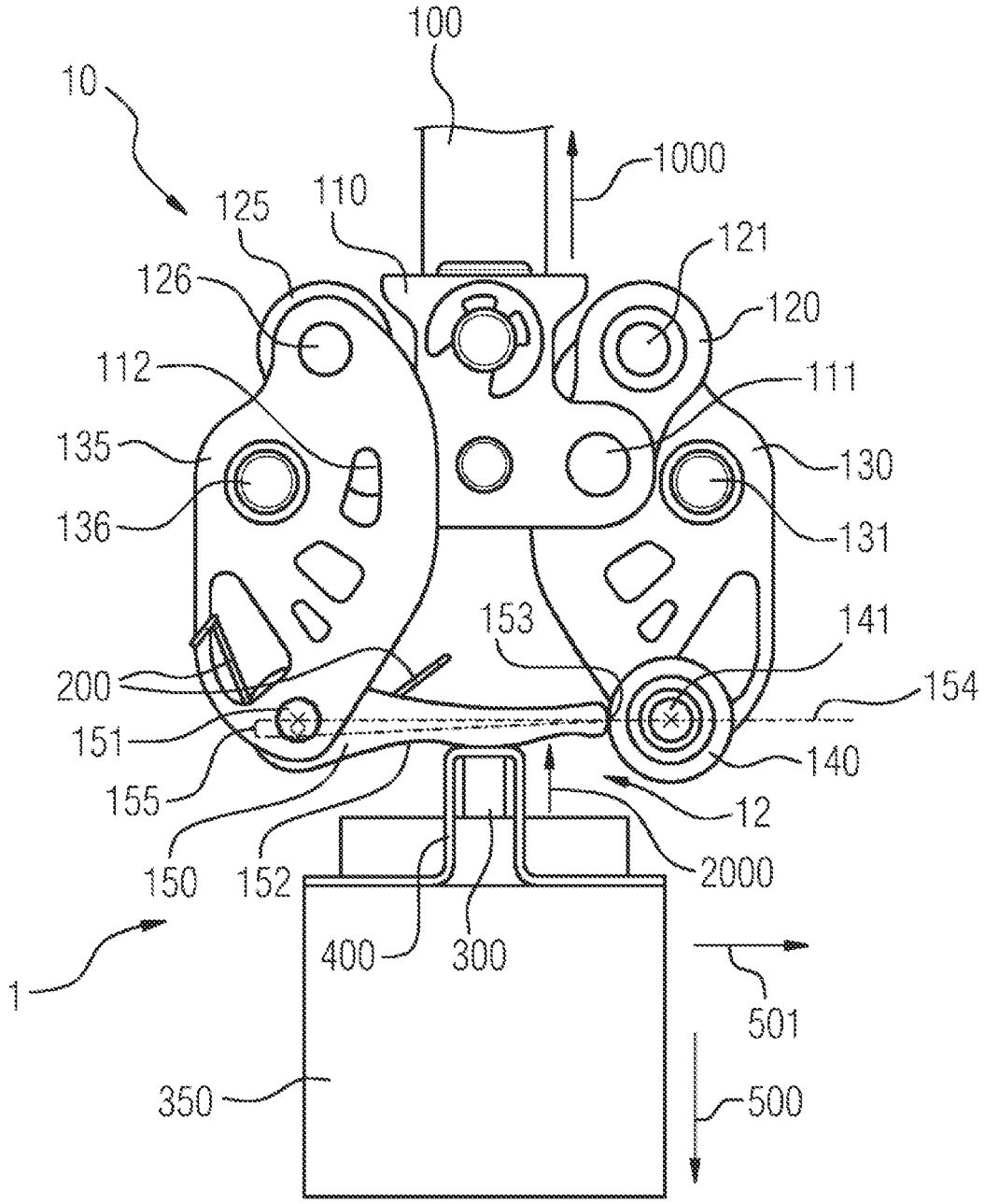
FIG. 1 shows a schematic illustration of a release mechanism according to the invention with a latch in a first end position.

FIG. 1 shows a schematic illustration of a release mechanism 1 according to the invention with a latch 10 in a first end position 12. The latch 10 here has a drive rod 100, which is connected to a switching unit (not shown)—for example a vacuum interrupter, a gas-insulated switch or a liquid-insulated switch, for example an oil-insulated switch.

In the first end position 12, the drive rod is subjected to a first force 1000, which in this case acts in the direction away from the latch 10.

The drive rod 100 here is also connected, in this case rigidly connected, to a connecting element 110. The connecting element 110 has a first rotary pin 111 and a second rotary pin 112. A first lever arm 120 is connected in a movable, in particular rotatable, manner to the connecting element 110 via the first rotary pin 111 and a second lever arm 125 is connected in a movable, in particular rotatable, manner to the connecting element 110 via the second rotary pin 112. The first lever arm 120 has a first lever-arm rotary pin 121 and the second lever arm 125 has a second lever-arm rotary pin 126.

A first transmission element 130 is connected in a movable, in particular rotatable, manner to the first lever arm 120 via the first lever-arm rotary pin 121 and a second transmission element 135 is connected in a movable, in particular rotatable, manner to the second lever arm 125 via the second lever-arm rotary pin 126.

The first transmission element 130 can be fastened in a rotatable manner on a housing (not shown) via a first fastening pin 131 and the second transmission element 135 can be fastened in a rotatable manner on a housing (not shown) via a second fastening pin 136. With the latch 10 installed, the movement of the first transmission element 130 and of the second transmission element 135 therefore takes place about the first fastening pin 131 at the first transmission element 130 and about the second fastening pin 136 at the second transmission element 135.

Furthermore, the first transmission element 130 is connected in a movable manner to a locking element 150 via a locking-element rotary pin. The second transmission element 135 is connected in a movable manner to a locking-element counterpart 140 via a bearing 141.

In the first end position 12 shown, the locking element 150 butts against the locking-element counterpart 140 such that it prevents a movement of the first transmission element 130 about the first fastening pin 131 and of the second transmission element 135 about the second fastening pin 136, at any rate a movement which can be brought about by the direction of action of the first force 1000. The locking-element counterpart 140 is formed here by a roller. During transfer from the second end position 14 into the first end position 12, the locking-element-return device 200, realized here by a spring, which in this case has been wound at least once around the locking-element rotary pin 151, causes the locking element 150 to be pushed back again into the locking position between the first transmission element 130 and the second transmission element 135.

At an end of the locking element 150 which is to be supported on the locking-element counterpart 140, the locking element 150 has a planar, that is to say rectilinear, or round shape, also referred to hereinbelow as contour 153, with a first radius and the locking element 150 is supported in a stable manner, in particular in a more stable manner, on the locking-element counterpart 140 in that, in the case of the contour 153 at one end of the locking element 150, the center point of the first radius does not pass through the center point of the locking-element rotary pin 151, that is to say the center point of the first radius is not located on a straight line 154 which passes through the center point of the locking-element rotary pin 151 and the center point of the bearing 141 of the locking-element counterpart 140; rather, in the first end position 12, it is offset in relation to said straight line 154 toward the side which is directed away from the drive rod, that is to say there is an offset 155 present, in particular an offset by 0.3 to 1.2 mm or 0.4 to 1.0 mm. The first radius here is preferably greater than a second radius of the locking-element counterpart 140, in particular with the locking-element counterpart 140 being in the form of a roller. As a result, the locking element 150 is always moved into a secure, latched state in the first end position 12 and, at the same time, relatively easy release, that is to say deflection of the locking element 150 out of the first end position, is made possible.

Furthermore in the optional refinement shown, in the region on the side which, in the first end position 12, is directed away from the drive rod 100, the locking element 150 has an indent 152, which corresponds to part of the outer contour of the locking-element counterpart 140, or replicates the same. The notch 152 therefore corresponds to an inverse form of part of the outer contour of the locking-element counterpart 140.

On that side of the locking element 150 which, in the first end position 12, is opposite to the drive rod, a magnetic drive 350 is arranged such that, in the case of the release mechanism 1 being released, the magnetic plunger 300 moves the locking element 150 out of the locking state of the first end position 12 by way of a second force 2000, and therefore the first force 1000, which acts on the drive rod 100 and by means of which the drive rod 100 can be moved in the direction of the first force 1000, transfers the latch 10 into the second end position 14.

FIG. 1 also shows, for a first installation state, the direction of the force of gravity 500 and, for an alternative installation state, the direction of the force of gravity 501. In case of doubt, the direction of the force of gravity 500 serves here to define terms such as top, over, bottom and/or under. The installation states are mentioned here by way of example, but all other installation states in space are also possible.

Moreover, FIG. 1 also shows an optional locking-element stop 400, which is arranged here on the magnetic drive 350 such that the locking-element stop 400 prevents the locking element 150 from moving beyond the first end position 12 in the direction of the magnetic drive 350 and, in addition, stabilizes the locking position of the locking element 150 in the first end position 12. As an alternative, it is also possible for the locking-element stop 400 to be arranged, with the same effect, on a housing (not shown here) or housing part 410.

Figure 2:
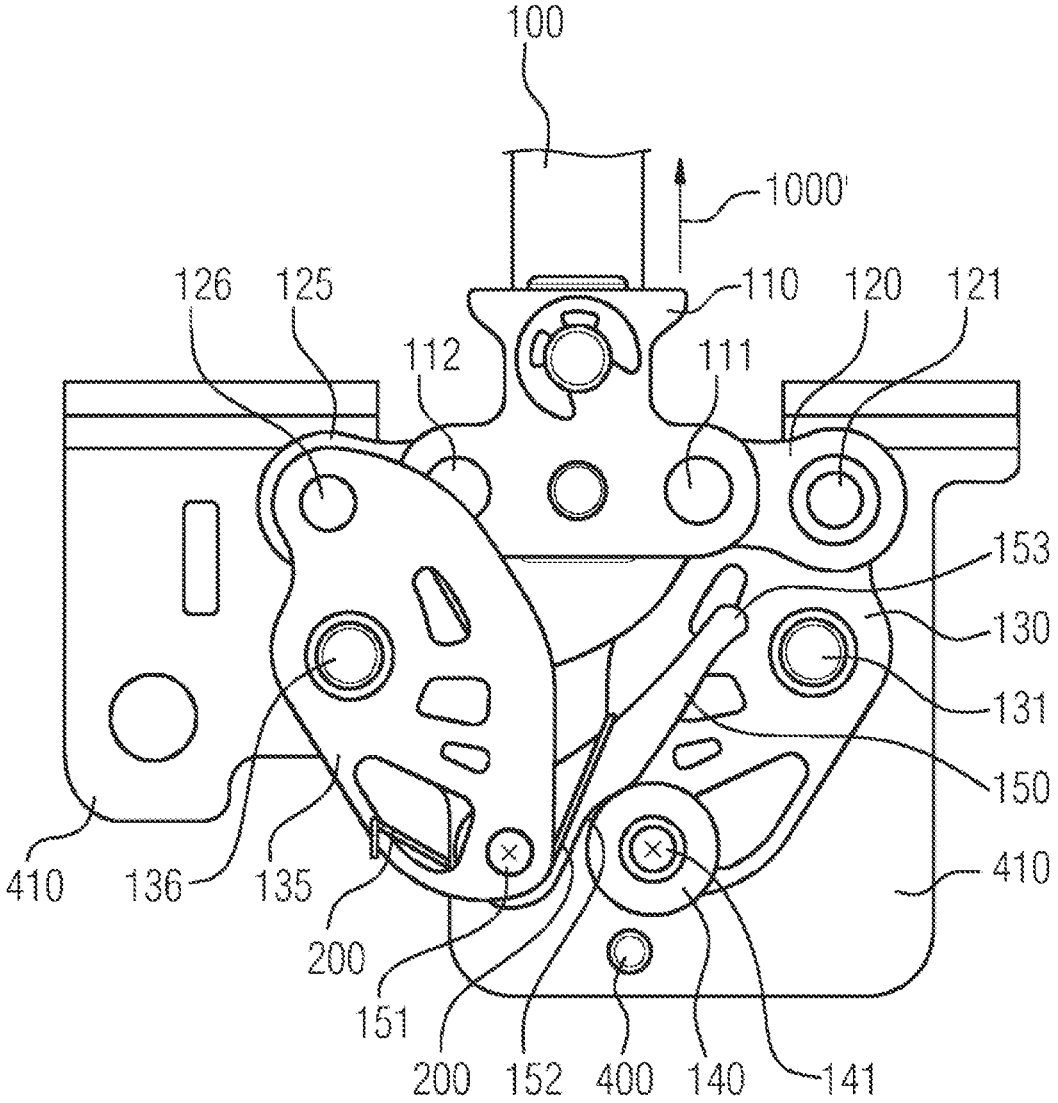
FIG. 2 shows a schematic illustration of a release mechanism according to the invention with a latch in a second end position.

FIG. 2 shows a schematic illustration of a release mechanism according to the invention with a latch 10 in a second end position 14, wherein this figure illustrates, in addition to FIG. 1, housing parts 410, on which the first transmission element 130 is arranged in a movable, in particular rotatable, manner by means of a first fastening pin 131 and the second transmission element 135 is arranged in a movable, in particular rotatable, manner by means of a second fastening pin 136. The housing parts, possibly together with other housing parts (not shown), form a housing, in which the latch is arranged in a movable manner.

In the second end position 14, a first force 1000' acts on the drive rod 100. The first force 1000, which is shown in FIG. 1, has transferred the drive rod 100 and the latch 10 as a whole, following removal of the locking element 150, from the first end position 12 into the second end position. Since some, or all, of the energy provided for this purpose has been used up as a result, a correspondingly smaller first force 1000' is active in the second end position 14.

In contrast to FIG. 1, the locking-element stop 400 here is arranged, as an alternative, on a housing part 410. This has the advantage that the stop for the locking element 150 is defined by the locking-element stop 400 on the housing part 410 and is therefore independent of the installation, in particular correct installation, of the magnetic plunger 300 and of the magnetic drive 350, neither of which is shown here.

FIG. 2 shows a latch 10 in a second end position 14, in a manner analogous to FIG. 1. The latch 10 here has a drive rod 100, which is connected to a switching unit (not shown)—for example a vacuum interrupter, a gas-insulated switch or a liquid-insulated switch, for example an oil-insulated switch.

The drive rod 100 here is also connected, in this case rigidly connected, to a connecting element 110. The connecting element 110 has a first rotary pin 111 and a second rotary pin 112. A first lever arm 120 is connected in a movable, in particular rotatable, manner to the connecting element 110 via the first rotary pin 111 and a second lever arm 125 is connected in a movable, in particular rotatable, manner to the connecting element 110 via the second rotary pin 112. The first lever arm 120 has a first lever-arm rotary pin 121 and the second lever arm 125 has a second lever-arm rotary pin 126.

A first transmission element 130 is connected in a movable, in particular rotatable, manner to the first lever arm 120 via the first lever-arm rotary pin 121 and a second transmission element 135 is connected in a movable, in particular rotatable, manner to the second lever arm 125 via the second lever-arm rotary pin 126.

The first transmission element 130 is fastened in a rotatable manner on the housing part 410 via a first fastening pin 131 and the second transmission element 135 is fastened in a rotatable manner on the housing part 410 via a second fastening pin 136. With the latch 10 installed, the movement of the first transmission element 130 and of the second transmission element 135 therefore takes place about the first fastening pin 131 on the first transmission element 130 and about the second fastening pin 136 on the second transmission element 135.

Furthermore, the first transmission element 130 is connected in a movable manner to a locking element 150 via a locking-element rotary pin. The second transmission element 135 is connected in a movable manner to a locking-element counterpart 140 via a bearing 141.

In the second end position 14 shown, the locking element 150 does not butt against the locking-element counterpart 140; rather, it has rolled over the locking-element counterpart 140, the locking-element counterpart 140 being configured here in the form of a roller.

In the second end position 14, the locking-element-return device 200 acts on the locking element 150, realized here by a spring, which in this case has been wound at least once around the locking-element rotary pin 151, such that the locking element 150 is pushed back again into the locking position between the first transmission element 130 and the second transmission element 135 when the latch is transferred again into the first end position 12 from FIG. 1. It is preferable here for an energy store (not shown), in particular a spring assembly or a cup-spring assembly 105, to be subjected to stressing.

At an end of the locking element 150 which is to be supported on the locking-element counterpart 140, the locking element 150 has a planar, that is to say rectilinear, or round shape, also referred to hereinbelow as contour 153, with a first radius and the locking element 150 is supported in a stable manner, in particular in a more stable manner, on the locking-element counterpart 140 in that, in the case of the contour 153 at one end of the locking element 150, the center point of the first radius does not pass through the center point of the locking-element rotary pin 151, that is to say the center point of the first radius is not located on a straight line 154 which passes through the center point of the locking-element rotary pin 151 and the center point of the bearing 141 of the locking-element counterpart 140; rather, in the first end position 12, it is offset in relation to said straight line 154 toward the side which is directed away from the drive rod, that is to say there is an offset 155 present, in particular an offset by 0.3 to 1.2 mm or 0.4 to 1.0 mm. The first radius here is preferably greater than a second radius of the locking-element counterpart 140, in particular with the locking-element counterpart 140 being in the form of a roller. As a result, the locking element 150 is always moved into a secure, latched state in the first end position 12 and, at the same time, relatively easy release, that is to say deflection of the locking element 150 out of the first end position, is made possible.

Furthermore in the optional refinement shown, in the region on the side which, in the first end position 12, is directed away from the drive rod 100, the locking element 150 has an indent 152, which corresponds to part of the outer contour of the locking-element counterpart 140, or replicates the same. The notch 152 therefore corresponds to an inverse form of part of the outer contour of the locking-element counterpart 140. In the second end position 14 shown, the locking-element counterpart 140 butts partially or wholly against the indent 152 and therefore makes possible a space-optimized construction and a more stable second end position 14.

Both in FIG. 1 and in FIG. 2, for the sake of better presentation, the first transmission element 130 and the second transmission element 135 are arranged on different sides of the connecting element 110. This is one possible arrangement, but it is also preferred to have an arrangement on one side of the connecting element 110 or duplication of the first transmission element 130 and of the second transmission element 135 like that in FIG. 5.

Figure 3:
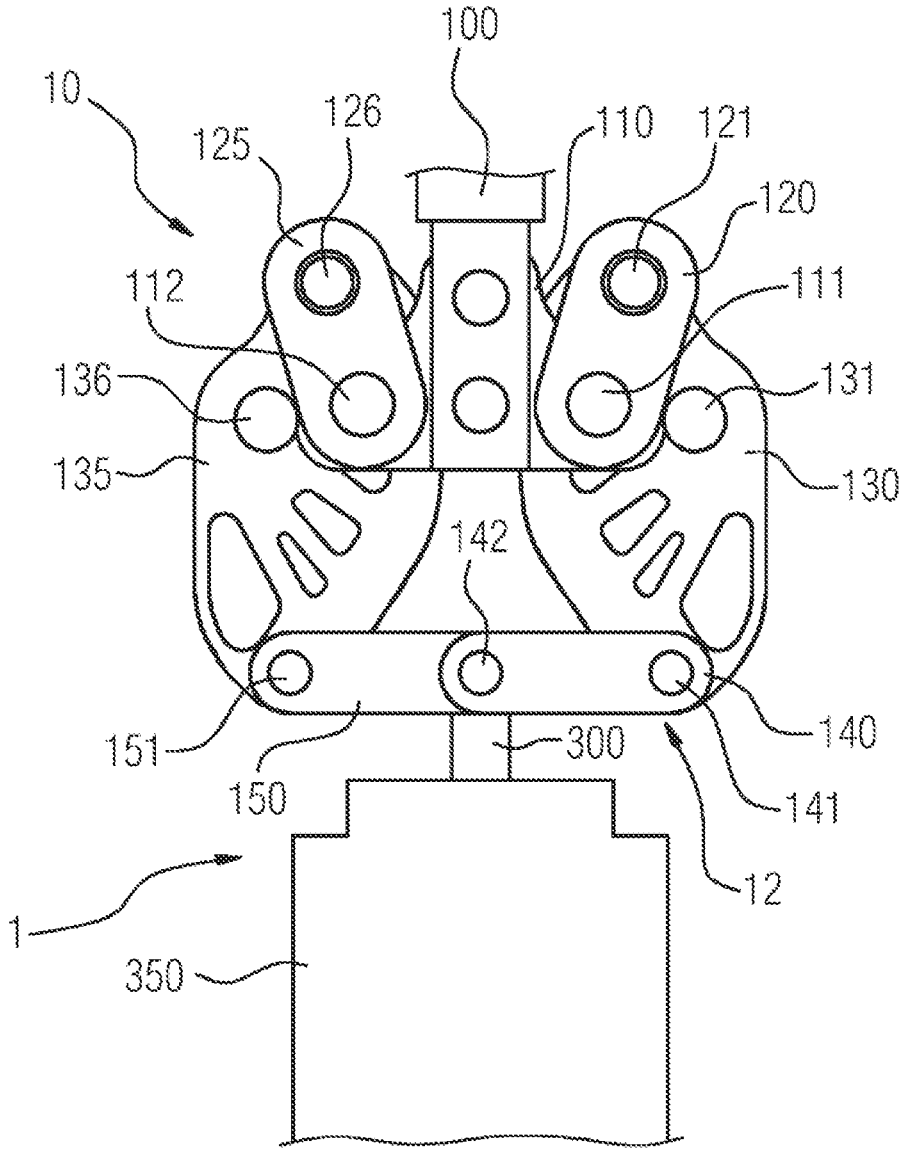
FIG. 3 shows a schematic illustration of an alternative release mechanism according to the invention with a latch in a first end position.

FIG. 3 shows a schematic illustration of an alternative release mechanism 1 according to the invention with a latch 10 in a first end position 12.

In contrast to FIGS. 1 and 2, the locking element 150 here is connected in a movable manner to the locking-element counterpart 140 at a connecting location 142, in particular in a rotatable manner about the connecting location 142.

In the case of the exemplary construction of FIG. 3, a drive rod 100 is once again connected firmly, in particular rigidly, to a connecting element 110.

The connecting element 110 has a first rotary pin 111 and a second rotary pin 112. A first lever arm 120 is connected in a movable, in particular rotatable, manner to the connecting element 110 via the first rotary pin 111 and a second lever arm 125 is connected in a movable, in particular rotatable, manner to the connecting element 110 via the second rotary pin 112. The first lever arm 120 has a first lever-arm rotary pin 121 and the second lever arm 125 has a second lever-arm rotary pin 126.

A first transmission element 130 is connected in a movable, in particular rotatable, manner to the first lever arm 120 via the first lever-arm rotary pin 121 and a second transmission element 135 is connected in a movable, in particular rotatable, manner to the second lever arm 125 via the second lever-arm rotary pin 126.

The first transmission element 130 can be fastened in a rotatable manner on a housing (not shown) via a first fastening pin 131 and the second transmission element 135 can be fastened in a rotatable manner on a housing (not shown) via a second fastening pin 136. With the latch 10 installed, the movement of the first transmission element 130 and of the second transmission element 135 therefore takes place about the first fastening pin 131 at the first transmission element 130 and about the second fastening pin 136 at the second transmission element 135.

On the second transmission element 135, the locking element 150 is arranged in a movable, in particular rotatable, manner on the locking-element rotary pin 151. The locking element 150 is connected once again in a movable, in particular rotatable, manner to the locking-element counterpart 140 at the connecting location 142, wherein the locking-element counterpart 140 here is elongate. The locking-element counterpart 140, for its part, is connected in a movable, in particular rotatable, manner to the first transmission element 130 via the bearing 141. In the first end position 12 shown here, the connecting location 142 and/or the locking element 150 and/or the locking-element counterpart 140 are/is located on the magnetic plunger 300 of the magnetic drive.

Figure 4:
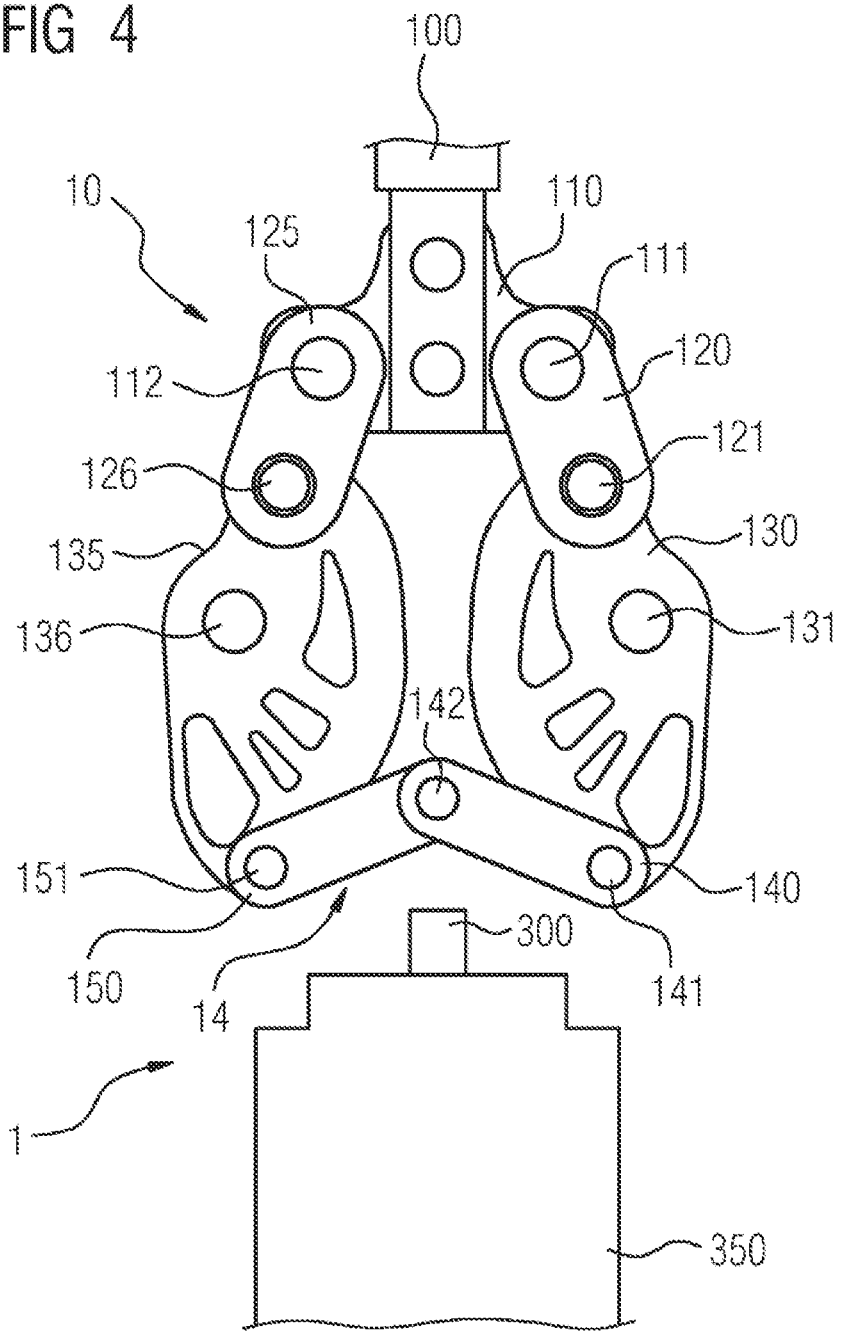
FIG. 4 shows a schematic illustration of an alternative release mechanism according to the invention with a latch in a second end position.

FIG. 4 shows a schematic illustration of an alternative release mechanism 1 according to the invention with the latch 10 from FIG. 3 in the second end position 14.

In the case of the exemplary construction of FIG. 4, a drive rod 100 is once again connected firmly, in particular rigidly, to a connecting element 110.

The connecting element 110 has a first rotary pin 111 and a second rotary pin 112. A first lever arm 120 is connected in a movable, in particular rotatable, manner to the connecting element 110 via the first rotary pin 111 and a second lever arm 125 is connected in a movable, in particular rotatable, manner to the connecting element 110 via the second rotary pin 112. The first lever arm 120 has a first lever-arm rotary pin 121 and the second lever arm 125 has a second lever-arm rotary pin 126.

A first transmission element 130 is connected in a movable, in particular rotatable, manner to the first lever arm 120 via the first lever-arm rotary pin 121 and a second transmission element 135 is connected in a movable, in particular rotatable, manner to the second lever arm 125 via the second lever-arm rotary pin 126.

The first transmission element 130 can be fastened in a rotatable manner on a housing (not shown) via a first fastening pin 131 and the second transmission element 135 can be fastened in a rotatable manner on a housing (not shown) via a second fastening pin 136. With the latch 10 installed, the movement of the first transmission element 130 and of the second transmission element 135 therefore takes place about the first fastening pin 131 at the first transmission element 130 and about the second fastening pin 136 at the second transmission element 135.

On the second transmission element 135, the locking element 150 is arranged in a movable, in particular rotatable, manner on the locking-element rotary pin 151. The locking element 150 is connected once again in a movable, in particular rotatable, manner to the locking-element counterpart 140 at the connecting location 142, wherein the locking-element counterpart 140 here is elongate. The locking-element counterpart 140, for its part, is connected in a movable, in particular rotatable, manner to the first transmission element 130 via the bearing 141.

In the second end position 14 shown here, following a release movement of the magnetic plunger 300, the connecting location 142 along with the locking element 150 and the locking-element counterpart 140 has become detached from the magnetic plunger 300 of the magnetic drive 350 and moves away from the magnetic plunger 300 as a result of the second force 2000, which is shown in FIG. 1. The first force 1000, which is shown in FIG. 1, has moved the drive rod 100 away from the magnetic drive 350 here.

Figure 5:
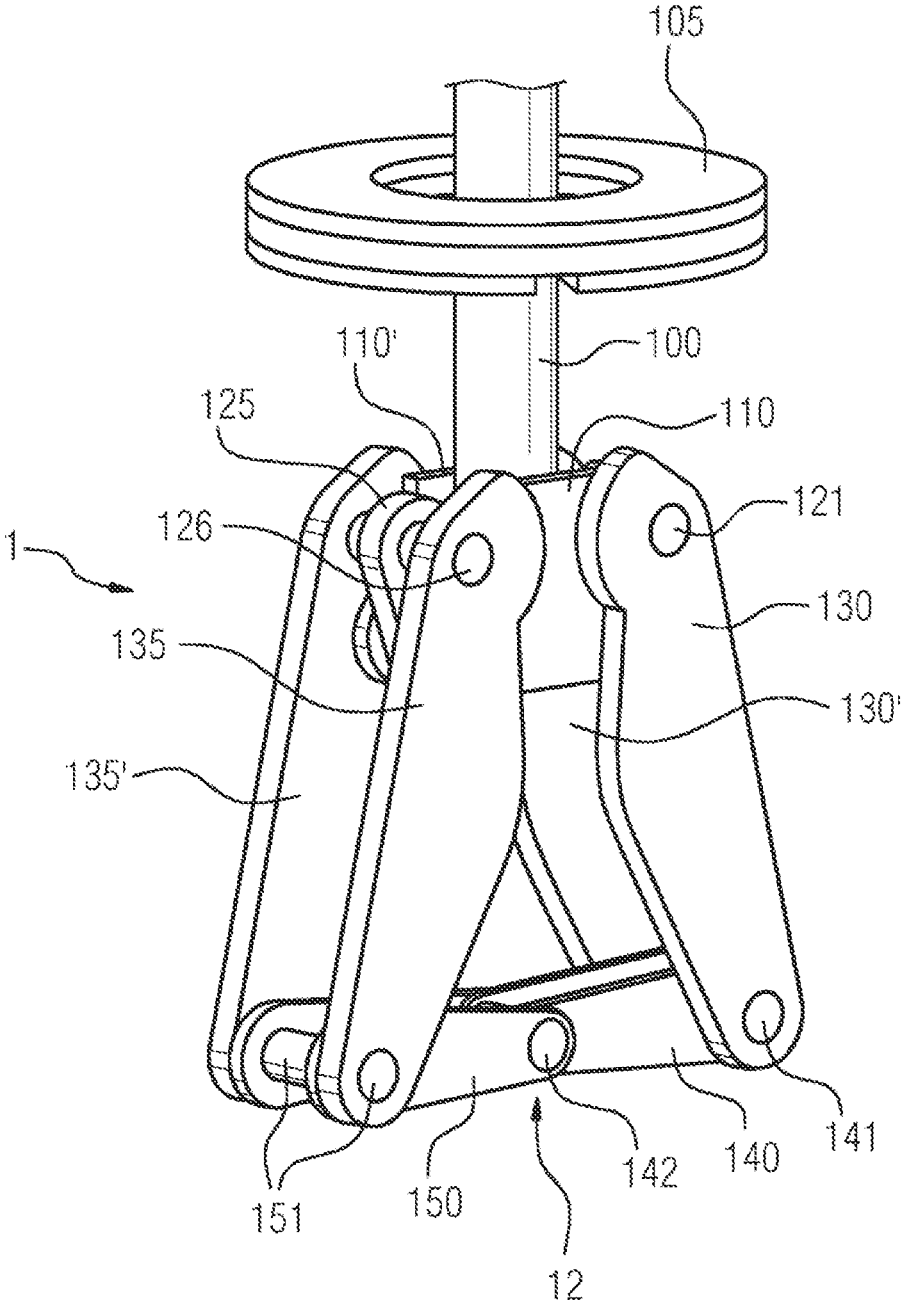
FIG. 5 shows a schematic illustration of an alternative release mechanism according to the invention with a latch in a first end position and with duplicated components.

FIG. 5 shows a schematic illustration of an alternative release mechanism 1 according to the invention with a latch 10 in a first end position 12 and with duplicated components, in this case the connecting elements 110, 110',
the first transmission elements 130, 130',
the second transmission elements 135, 135',
the locking elements 150, 150', and
the locking-element counterparts 140, 140'.

The drive rod 100 here is connected to a cup-spring assembly 105 for the purpose of generating the first force 1000 (not shown here), see FIG. 1.

The drive rod 100 is connected to connecting elements 110, 110', that is to say duplicated connecting elements which are located opposite one another at one end of the drive rod. A first lever arm 120 (not visible here) is connected in a rotatable manner to the connecting elements 110, 110' via the first rotary pin 111 (not visible here) and a second lever arm 125 is connected in a rotatable manner to the connecting elements 110, 110' via the second rotary pin 112 (not visible here).

The first lever arm 120 and the second lever arm 125 are each arranged here, by way of example, between the two connecting elements 110, 110'.

The first lever arm 120 is connected in a rotatable manner to the two first transmission elements 130, 130' via a first lever-arm rotary pin 121, wherein the first lever arm 120 is arranged between the two first transmission elements 130, 130'.

The second lever arm 125 is connected in a rotatable manner to the two second transmission elements 135, 135' via a second lever-arm rotary pin 126, wherein the second lever arm 125 is arranged between the two second transmission elements 135, 135'.

Although not shown here, it is possible for the two first transmission elements 130, 130' to be fastened in a rotatable manner on a housing via the first fastening pin 131 and for the two second transmission elements 135, 135' to be fastened in a rotatable manner on a housing via the second fastening pin 136.

On the two second transmission elements 135, 135', two locking elements 150, 150' are arranged in a rotatably connected manner between the two second transmission elements 135, 135' via a locking-element rotary pin 151.

On the two first transmission elements 130, 130', two locking-element counterparts 140, 140' are arranged in a rotatably connected manner between the two first transmission elements 130, 130' via a bearing 141, in this case designed in the form of a pin.

The two locking elements 150, 150' are connected in a rotatable manner to the two locking-element counterparts 140, 140' at a connecting location 142, in this case designed in the form of a pin.

Although not shown here, it is also possible, as an option, for the lever-arm pair 120, 125 to be duplicated.

LIST OF REFERENCE SIGNS

1 Release mechanism;
10 Latch;
12 First end position;
14 Second end position;
100 Drive rod;
105 Cup-spring assembly;
110 Connecting element;
110' Connecting element;
111 First rotary pin on the connecting element 110;
112 Second rotary pin on the connecting element 110;
120 First lever arm;
121 First lever-arm rotary pin on the first lever arm 120;
125 Second lever arm;
126 Second lever-arm rotary pin on the second lever arm 125;
130 First transmission element;
130' First transmission element;
131 First fastening pin on the first transmission element 130;
135 Second transmission element;
135' Second transmission element;
136 Second fastening pin on the second transmission element 135;
140 Locking-element counterpart;
140' Locking-element counterpart;
141 Bearing, preferably needle bearing or ball bearing for the locking-element counterpart;
142 Connecting location, in particular movable connecting location between locking element 150 and locking-element counterpart 140;
150 Locking element;
150' Locking element;
151 Locking-element rotary pin;
152 Indent on one side of the locking element;
153 Contour at one end of the locking element;
154 Straight line through the center point of the locking-element rotary pin 151 and the center point of the bearing 141;
155 Offset between the center point of the locking-element rotary pin 151 and center point or starting point of the first radius;
200 Locking-element-return device, in particular a locking-element-return spring;
300 Magnetic plunger;
350 Magnetic drive;
400 Locking-element stop;
410 Housing parts;
500 Force of gravity;
501 Force of gravity in a different installation state;
1000 First force;
2000 Second force.

The invention claimed is:

1. A latch for low-voltage, medium-voltage, or high-voltage applications, the latch comprising:
a drive rod for driving a movement;
a connecting element connected to, or integrated with, said drive rod;
a lever-arm pair;
a transmission-element pair;
a locking element; and
a locking-element counterpart;
wherein a first force, which acts on said drive rod, is reduced to a second force by:
said connecting element;
said lever-arm pair; and
said transmission-element pair;
such that the second force, which is smaller then the first force, is sufficient to deflect said locking element so that a movement of said drive rod relative to said lever-arm pair and said transmission-element pair is no longer prevented by said locking element or by said locking element together with said locking-element counterpart;
wherein:
the latch has a first end position and a second end position; and
said drive rod is connected to said connecting element;
said connecting element has a first rotary pin and a second rotary pin, and wherein a first lever arm is fastened and rotatably mounted on said first rotary pin and a second lever arm is fastened and rotatably mounted on said second rotary pin;
said first lever arm has a first lever-arm pin and said second lever arm has a second lever-arm pin;
said first transmission element is movably connected to said first lever arm via said first lever-arm pin and said second transmission element is movably connected to said second lever arm via said second lever-arm pin;
said first transmission element is rotatably mountable, or rotatably mounted, on a first housing part via said first fastening pin and said second transmission element is rotatably mountable, or rotatably mounted, on a second housing part via a second fastening pin;
said first transmission element or said second transmission element is connected to a rotatably mounted locking element via a locking-element pin, wherein said locking element is mountable on a locking-element counterpart or is connected to said locking-element counterpart, wherein said locking-element counterpart is connected to said second transmission element or to said first transmission element;

during a transition from the first end position into the second end position, said drive rod moves away from said first fastening pin on said first transmission element, and from said second fastening pin on said second transmission element, and said locking-element pin and said locking-element counterpart move toward one another; and during a transition from the second end position into the first end position, said drive rod moves toward said first fastening pin on said first transmission element, and toward said second fastening pin on said second transmission element, and said locking-element pin and said locking-element counterpart move apart from one another; and in the first end position, said locking element is arranged between said first transmission element and said second transmission element to thereby inhibit a movement of said transmission-element pair.

2. The latch according to claim 1, wherein:

said locking element and said locking-element counterpart are movably connected to one another at a connecting location;

said locking-element counterpart is rotatably connected to said second transmission element or said first transmission element, and:

in the first end position, said locking element and said locking-element counterpart are disposed in a straightened-out state, in which the latch is prevented from moving into the second end position; and in the second end position, said locking element and said locking-element counterpart are disposed in an inflected state, in which relative to the first end position, the connecting location between said locking element and said locking-element counterpart has moved in a direction of said drive rod.

3. The latch according to claim 2, wherein said locking element and said locking-element counterpart are rotatably connected to one another at said connecting location.

4. A latch for low-voltage, medium-voltage, or high-voltage applications, the latch comprising:

a drive rod for driving a movement;

a connecting element connected to, or integrated with, said drive rod;

a lever-arm pair;

a transmission-element pair;

a locking element; and a locking-element counterpart;

wherein a first force, which acts on said drive rod, is reduced to a second force by:

said connecting element;

said lever-arm pair; and said transmission-element pair;

such that the second force, which is smaller then the first force, is sufficient to deflect said locking element so that a movement of said drive rod relative to said lever-arm pair and said transmission-element pair is no longer prevented by said locking element or by said locking element together with said locking-element counterpart;

said locking element and said locking-element counterpart are movably connected to one another at a connecting location;

said locking-element counterpart is rotatably connected to said second transmission element or said first transmission element, and:

in a first end position, said locking element and said locking-element counterpart are disposed in a straightened-out state, in which the latch is prevented from moving into the second end position; and in a second end position, said locking element and said locking-element counterpart are disposed in an inflected state, in which relative to the first end position, the connecting location between said locking element and said locking-element counterpart has moved in a direction of said drive rod;

said locking element and said locking-element counterpart being movably connected by a rotary pin at said connecting location; and said locking-element counterpart being rotatably connected to said second transmission element or said first transmission element by a pin or a bearing, and said connecting location being arranged approximately centrally between said bearing and said locking-element pin.

5. The latch according to claim 4, wherein, in the first end position, said locking element is mounted on said locking-element counterpart such that said locking element prevents the latch from moving out of the first end position.

6. The latch according to claim 5, wherein said locking-element counterpart is a roller.

7. The latch according to claim 6, wherein said bearing is a needle bearing.

8. The latch according to claim 5, which comprises a locking-element-return device disposed on said locking element, said locking-element-return device being configured, when the latch transitions from the second end position into the first end position, to cause the locking element to be returned to a position between said first transmission element and said second transmission element, and therefore a movement of said transmission-element pair is inhibited and said locking element abuts against said locking-element counterpart.

9. The latch according to claim 5, wherein said locking-element counterpart is a roller and said locking element, on a side which, in the first end position, is directed away from said drive rod, is formed with an indent that corresponds to an outer contour of said locking-element counterpart.

10. A latch for low-voltage, medium-voltage, or high-voltage applications, the latch comprising:

a drive rod for driving a movement;

a connecting element connected to, or integrated with, said drive rod;

a lever-arm pair;

a transmission-element pair;

a locking element; and a locking-element counterpart;

wherein a first force, which acts on said drive rod, is reduced to a second force by:

said connecting element;

said lever-arm pair; and said transmission-element pair;

such that the second force, which is smaller then the first force, is sufficient to deflect said locking element so that a movement of said drive rod relative to said lever-arm pair and said transmission-element pair is no longer prevented by said locking element or by said locking element together with said locking-element counterpart;

wherein:

said first transmission element and said second transmission element are movably mounted on a same side, or on opposite sides, of said connecting element; or said connecting element is formed from two connecting-element parts, and said first and second transmission elements are movably mounted between said two connecting-element parts.

11. A release mechanism for a high-speed switch, the release mechanism comprising:

a latch having:

a drive rod for driving a movement;

a connecting element connected to, or integrated with, said drive rod;

a lever-arm pair;

a transmission-element pair;

a locking element; and a locking-element counterpart;

wherein a first force, which acts on said drive rod, is reduced to a second force by:

said connecting element;

said lever-arm pair; and said transmission-element pair;

such that the second force, which is smaller then the first force, is sufficient to deflect said locking element so that a movement of said drive rod relative to said lever-arm pair and said transmission-element pair is no longer prevented by said locking element or by said locking element together with said locking-element counterpart;

and a magnetic plunger of a magnetic drive or another release unit configured to move the locking element out of a first end position in which a movement of the transmission-element pair is inhibited.

12. The release mechanism according to claim 11, wherein, in the first end position, the locking element butts on or against a locking-element stop.

13. The release mechanism according to claim 12, wherein said locking-element stop is arranged on the magnetic drive or on one or more housing parts.

14. A latch for low-voltage, medium-voltage, or high-voltage applications, the latch comprising:

a drive rod for driving a movement;

a connecting element connected to, or integrated with, said drive rod;

a lever-arm pair;

a transmission-element pair;

a locking element; and a locking-element counterpart;

wherein a first force, which acts on said drive rod, is reduced to a second force by:

said connecting element;

said lever-arm pair; and said transmission-element pair;

such that the second force, which is smaller then the first force, is sufficient to deflect said locking element so that a movement of said drive rod relative to said lever-arm pair and said transmission-element pair is no longer prevented by said locking element or by said locking element together with said locking-element counterpart;

a magnetic plunger of a magnetic drive or another release unit configured to move the locking element out of the first end position in which a movement of the transmission-element pair is inhibited;

wherein, in an end position, the locking element butts on or against a locking-element stop arranged on the magnetic drive or on one or more housing parts; and wherein:

said first transmission element is rotatably mounted, or rotatably mountable, on a first housing part via a first fastening pin and said second transmission element is rotatably mountable, or rotatably mounted, on a second housing part via a second fastening pin; and said first and second housing parts are immovably fastened in a housing of the release mechanism or said first and second housing parts form the housing of the release mechanism.

15. A high-speed grounding switch or short-circuiter, comprising:

a latch for low-voltage, medium-voltage, or high-voltage applications, the latch including:

a drive rod for driving a movement;

a connecting element connected to, or integrated with, said drive rod;

a lever-arm pair;

a transmission-element pair;

a locking element; and a locking-element counterpart;

wherein a first force, which acts on said drive rod, is reduced to a second force by:

said connecting element;

said lever-arm pair; and said transmission-element pair;

such that the second force, which is smaller then the first force, is sufficient to deflect said locking element so that a movement of said drive rod relative to said lever-arm pair and said transmission-element pair is no longer prevented by said locking element or by said locking element together with said locking-element counterpart; and a magnetic plunger of a magnetic drive or another release unit configured to move the locking element out of an end position in which a movement of the transmission-element pair is inhibited;

wherein the release mechanism is arranged, together with the switch, in a housing and, following a switching from the first end position into the second end position, the release mechanism can be reversibly restored into the first end position.

* * * * *